United States Patent [19]

Castellarin

[11] Patent Number: 4,475,799

[45] Date of Patent: Oct. 9, 1984

[54] FILM DEVELOPING MACHINE WITH DEVICES FOR LOADING AND TRANSFERRING FILM SUPPORTING FRAMES

[75] Inventor: Silvano Castellarin, Pordenone, Italy

[73] Assignee: Fotomec-San Marco S.p.A., Pordenone, Italy

[21] Appl. No.: 530,342

[22] Filed: Sep. 8, 1983

[30] Foreign Application Priority Data

Sep. 28, 1982 [IT] Italy ..... 45731 A/82

[51] Int. Cl.[3] ..... G03D 3/10

[52] U.S. Cl. ..... 354/308; 354/316; 354/322; 134/76; 134/133

[58] Field of Search ..... 354/308, 309, 312, 315, 354/316, 319, 320, 322; 134/48, 76, 77, 133, 134

[56] References Cited

U.S. PATENT DOCUMENTS

| | | | |
|---|---|---|---|
| 2,980,006 | 4/1961 | Nieuwenhoven et al. | 354/316 |
| 3,624,728 | 11/1971 | Clark | 354/322 |
| 4,208,119 | 6/1980 | Spence-Bate et al. | 134/76 |

FOREIGN PATENT DOCUMENTS

| | | | |
|---|---|---|---|
| 2043490 | 10/1980 | United Kingdom | 354/322 |

*Primary Examiner*—A. A. Mathews

*Attorney, Agent, or Firm*—Wenderoth, Lind & Ponack

[57] ABSTRACT

A film developing machine includes a film loading section for receiving therein frames supporting film to be developed, a developing section having a series of basins for containing chemical baths used for development, a transferring system for transferring film supporting frames through the developing section and immersing the film in the chemical baths in the basins, and a drying and unloading section for receiving developed film from the developing section and drying the film. A light-tight casing houses each of the sections. A vertically movable guide moves film supporting frames downwardly within the film loading section to a lower portion thereof. A feeder is located in the developing section at a position beneath the lower portion of the film loading section and receives film supporting frames transferred from the guide and feeds such frames to the transferring system. The movements of the feeder and the transferring system are synchronized such that each film supporting frame is at a predetermined position to be received by the transferring system from the feeder.

6 Claims, 3 Drawing Figures

FILM DEVELOPING MACHINE WITH DEVICES FOR LOADING AND TRANSFERRING FILM SUPPORTING FRAMES

BACKGROUND OF THE INVENTION

The present invention relates to a film developing machine including structure or devices for loading and transferring throughout the machine frames supporting films of various sizes, be they flat or on reels.

Known machines of this type usually include a section for loading the films to be developed on transfer frames which are hooked onto a vertical displacement and transfer system for the purpose of passing the frames through a series of chemical treatment baths. Then, the films, still held by the frames, are introduced into a drying section from which they exit in developed and completely dry condition. To prevent damage to the latent images on the films, it is necessary to operate known developing machines in darkrooms, at least with regard to the loading section and the development by chemical bath treatment section. This inevitably causes considerable inconvenience for the operator who must work in complete darkness, and it also requires the provision of appropriate protective and safety devices on the machines in order to meet the requirements of various international standards.

SUMMARY OF THE INVENTION

With the above discussion in mind, the object of the present invention is to provide a film developing machine which can be operated in normal daylight, thereby avoiding the above and other prior art disadvantages, and to allow for a higher degree of reliability during performance of the developing operations.

It is a further and more specific object of the present invention to provide a film developing machine including structure for loading and transferring film supporting frames in a manner such that undeveloped film is not subjected to normal light.

These objects are achieved in accordance with the present invention by the provision of a film developing machine of the type including a film loading section for receiving therein frames supporting film to be developed, a developing section having a series of basins for containing chemical baths used for development, a system for transferring film supporting frames through the developing section and immersing the film in the chemical baths in the basins, and a drying and unloading section for receiving developed film from the developing section and drying the film. In accordance with the present invention, there is provided a light-tight casing housing each of the loading, developing and drying and unloading sections. A vertically movable guide device is provided in the loading section and enables the film supporting frames to be moved downwardly within the film loading section to a lower portion thereof. A frame feeder is located in the developing section at a position beneath the lower portion of the film loading section and receives film supporting frames transferred from the guide and feeds such film supporting frames to the transferring system. The operation of the feeder and the transferring system are synchronized such that each film supporting frame is at a predetermined position to be received by the transferring system from the feeder. Specifically, the transferring system is of known structure and includes hook members which move vertically and hook-up a frame from the feeder at the predetermined position, and the transferring system then sequentially moves and immerses the film supported by the frame through the various basins containing the chemical development baths.

In accordance with a further feature of the present invention there is provided an opening between the lower portion of the film loading section and the developing section, to enable transfer of a film supporting frame from the guide to the feeder. A shutter selectively closes the opening to render the developing section light-tight when a new film supporting frame is to be loaded into the film loading section.

In accordance with a further feature of the present invention, the film loading section includes an openable door for loading of film supporting frames, and the door includes a flexible, for example fabric, panel having light-tight openings for passage therethrough of the arms of an operator to open film supported by a frame on the guide within the loading section.

In accordance with a further feature of the present invention, the structure for synchronizing the operation of the feeder and the transferring system may include a microswitch for detecting the location of each frame at a position upstream of the predetermined position with respect to the direction of movement of the frame by the feeder, and a timer for determining the time required for the feeder to move the frame from such upstream position to the predetermined position, whereat the hook members of the transferring system move vertically upwardly and remove the frame from the feeder.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
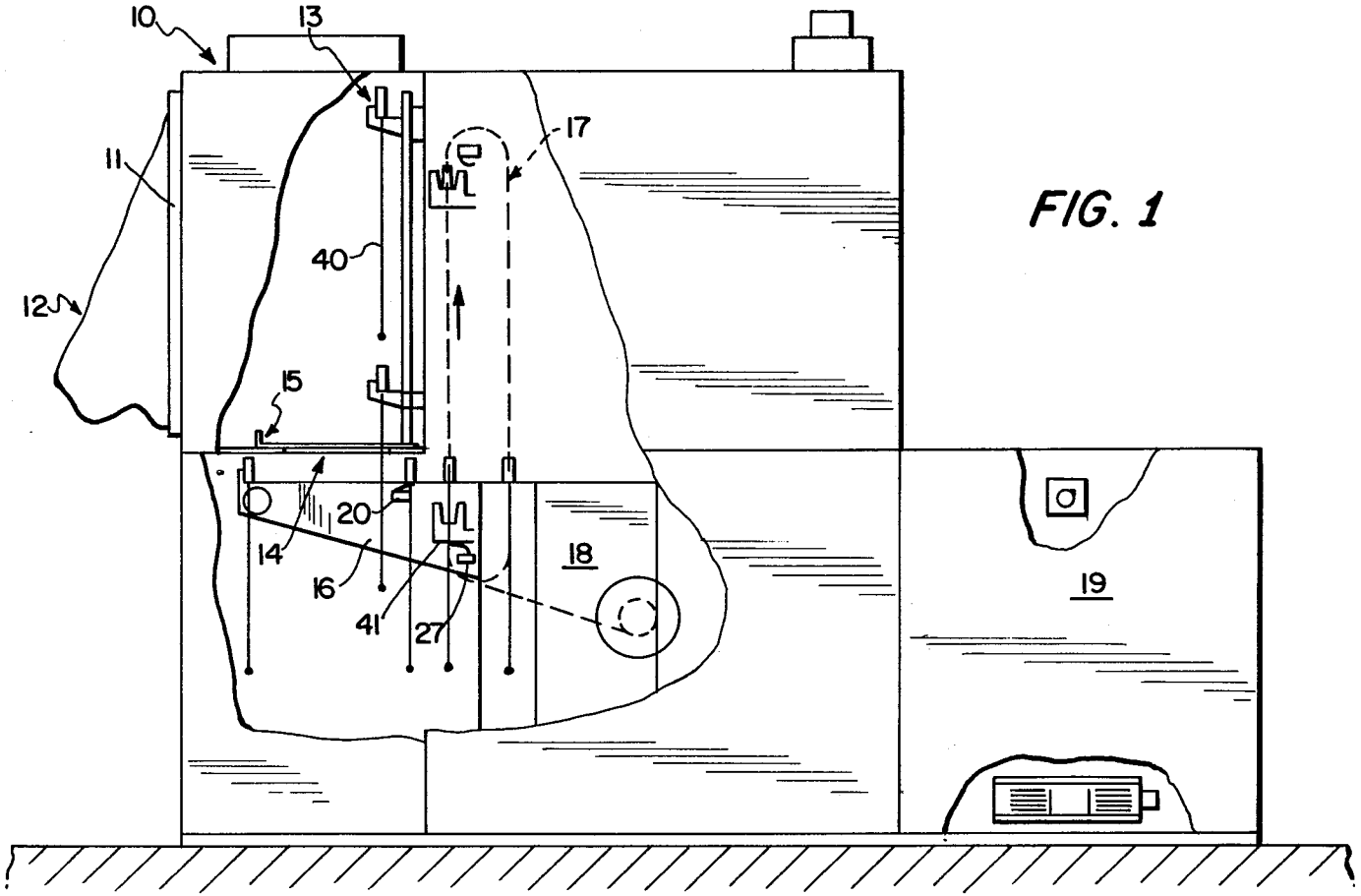
FIG. 1 is a schematic elevation view, partially broken away, illustrating a film developing machine in accordance with the present invention.

FIG. 1 generally illustrates a film developing machine according to the present invention. Such machine includes a film loading section 10, a developing section having a series of basins 18 for containing chemical baths used for development, a transferring system 17 for transferring film supporting frames 40 through the developing section and immersing the film in the chemical baths in basins 18, and a drying and unloading section 19 for receiving developed film from the developing section and drying the film. The films are withdrawn from section 19 developed and dried completely.

All of the sections, i.e. the loading section 10, the developing section and the unloading and drying section 19 are each housed within a light-tight casing. The casing is accessible from the front through a door formed by a frame 11 and by a flexible panel 12, for example of fabric, with light-tight openings for the receipt therethrough of the arms of an operator.

Figure 2:
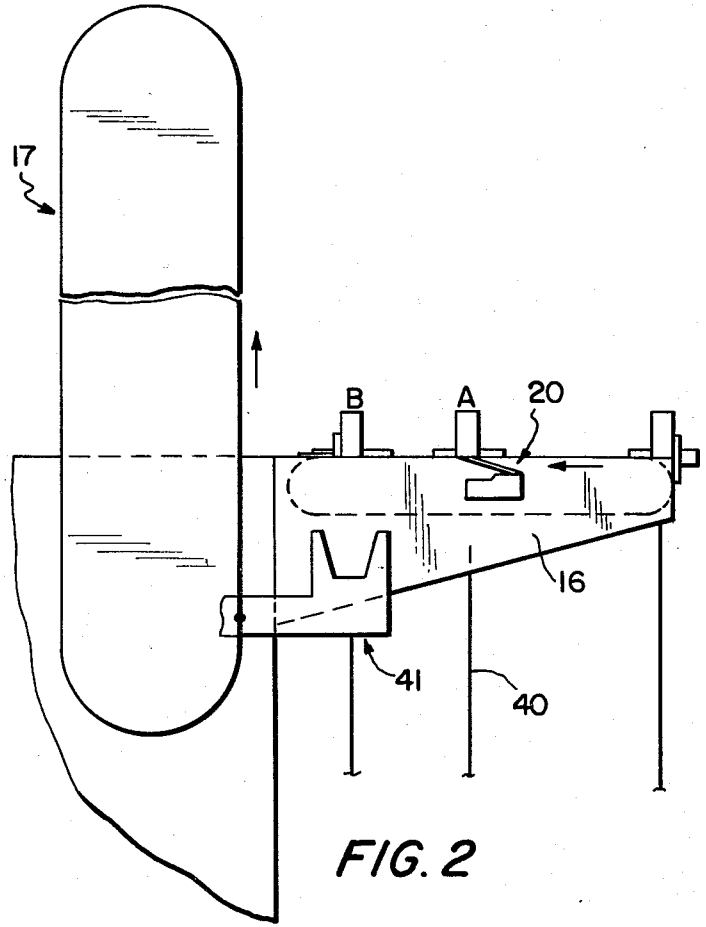
FIG. 2 is an enlarged partial view of a portion of the machine shown in FIG. 1, but viewed from the opposite side thereof.

Within loading section 10 there is mounted a guide 13 which is vertically slidably movable and on which film supporting frames 40 may be mounted. Beneath slide 13 is an opening 14 between the lower portion of loading section 10 and the developing section. A shutter 15 is mounted for selectively opening and closing opening 14. Beneath opening 14 and shutter 15 is a feeder 16 operable to receive film supporting frames 40 transferred from the guide 13. Feeder 16 feeds film supporting frames 40 horizontally to transferring system 17. Specifically, feeder 16 moves each frame 40 to a predetermined position (B in FIG. 2) whereat hook members 41 of transferring system 17 move vertically upwardly and hook-up or catch the frame 40 and remove the frame from feeder 16. Transferring system 17 is not in and of itself novel, but rather it is intended that the present invention be operable with any known type of transferring system. One such known type of transferring system 17 has a supporting device provided with a plurality of evenly spaced apart arms or forks 41, each of which can support a corresponding frame 40. System 17 is of the so-called "dip and dunk" type, whereby the system is rotated in a clockwise direction as viewed in FIG. 1, such that arms 41 move downwardly to position a frame 40 on the upper side of a bath tray 18. Accordingly, the film is temporarily immersed in a corresponding bath until the supporting device of system 17 moves upwardly such that another arm 41 picks up the frame 40 and brings it to the next bath in the manner described above. In this way, each frame 40 supported by an arm 41 is repeatedly laid down upon one of the baths in a respective basin 18, picked up by an adjacent arm 41, then laid down on the next bath, and so on. Finally, each frame 40 is positioned on a belt feeder, similar to feeder 16, which moves it through the drying suction 19. This structure also is known and does not form a portion of the present invention.

Figure 3:
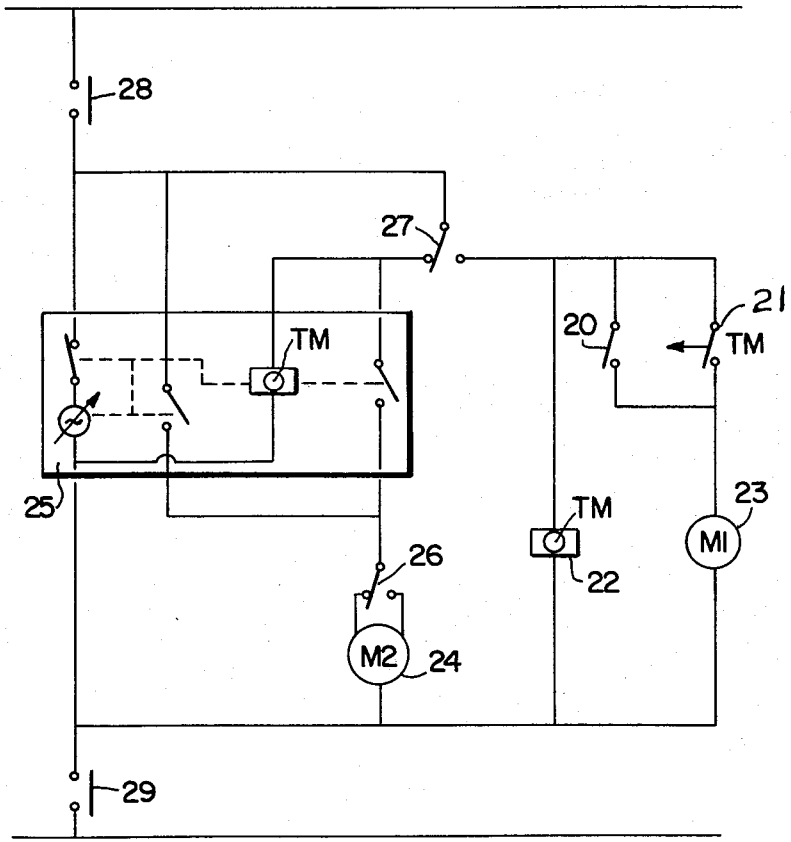
FIG. 3 is a schematic circuit diagram of structure for synchronizing the operation of the machine of FIG. 1.

In accordance with the present invention, however, feeder 16 and transfer system 17 are synchronized by means of an electromechanical circuit, in a manner such that each film supporting frame is at predetermined position B to be received by the respective arm 41 from feeder 16. Thus, a microswitch 20, shown most clearly in FIG. 2, senses the location of a given frame 40 at a position A upstream of predetermined position B with respect to the direction of movement of the frame 40 by feeder 16. Microswitch 20 is a portion of the circuit illustrated schematically in FIG. 3, and is connected in parallel to a timing contact 21 of a timer 22 which determines the time required for feeder 16 to move the frame 40 from upstream position A to the predetermined position B. Microswitch 20 is in series with a motor 23 controlling the forward movement of feeder 16. Transferring system 17 is controlled by a motor 24 and is regulated by a governor 25 of known construction. Motor 24 has two operating speeds, i.e. one speed for vertical motion and another speed for translatory motion, determined by the position of a switch 26. Another microswitch 27 determines the end of travel of transferring system 17 and the start of counting of the time of arrest of the device carried out by governor 25. Microswitch 20 enables a frame 40 to move a given distance in a given specified safety time, determined by timer 22, before system 17 starts moving. This is to prevent frame 40 from reaching an intermediate position between position A and the predetermined position B when device 17 starts to move. The circuit also includes safety switches 28 and 29 on the supply network.

Although it is believed that the manner of operation of the present invention is apparent from the above, such operation now will be described. Thus, an operator first opens the front door of loading section 10 and hangs a frame 40, containing film to be developed, on guide 13. After closing the door, the operator inserts his arms through the light-tight openings in flexible panel 12, opens the film packages previously positioned on frame 40, and uncoils the film on the frame. The operator then opens shutter 15 and lowers the guide 13 to the lower portion of section 10. At this point, the operator transfers frame 40 supporting the uncoiled film onto feeder 16, raises guide 13 and then closes shutter 15. Upon closing of shutter 15, the developing section then is light-tight, and the operator may again open the door of the loading section 10 to commence loading of another frame.

Upon transfer of the film supporting frame 40 to the feeder 16, feeder 16 is set in motion only at a period of time when transfer system 17 is at a standstill. Feeder 16 moves the film supporting frame to the transferring system, and system 17 removes the film supporting frame from feeder 16 in the manner described above.

Although the present invention has been described and illustrated with respect to a preferred embodiment, it is to be understood that various modifications and changes may be made without departing from the scope of the present invention. Furthermore, it is to be understood that various elements of the present invention, such as the developing section, the construction and location of the chemical bath containing basins 18, the transferring system 17, and the drying and unloading section 19 are conventional and in and of themselves do not form novel portions of the present invention. Further, feeder 16 may be of various constructions, such as belt or chain assemblies, as will be apparent to those skilled in the art.

I claim:

1. In a film developing machine of the type including a film loading section for receiving therein frames supporting film to be developed, a developing section having a series of basins for containing chemical baths used for development, means for transferring film supporting frames through said developing section and immersing the film in the chemical baths in said basins, and a drying and unloading section for receiving developed film from said developing section and drying the film, the improvement comprising:

a light-tight casing housing each said section;

vertically movable guide means for moving film supporting frames downwardly within said film loading section to a lower portion thereof;

feeder means, located in said developing section at a position beneath said lower portion of said film loading section, for receiving film supporting frames transferred from said guide means and feeding such film supporting frames to said transferring means; and means for synchronizing movement of said feeder means and said transferring means such that each film supporting frame is at a predetermined position to be received by said transferring means from said feeder means.

2. The improvement claimed in claim 1, further comprising opening means, between said lower portion of said film loading section and said developing section, for enabling transfer of a film supporting frame from said guide means to said feeder means, and shutter means for closing said opening means to render said developing section light-tight when a new film supporting frame is to be loaded into said film loading section.

3. The improvement claimed in claim 1, wherein said film loading section includes an openable door for loading of film supporting frames, said door including a flexible panel having light-tight openings for the arms of an operator.

4. The improvement claimed in claim 1, wherein said transferring means includes hook members operable to remove the frames from said feeder means.

5. The improvement as claimed in claim 1, wherein said feeder means comprises means for horizontally moving the frames sequentially to said predetermined position.

6. The improvement claimed in claim 1, wherein said synchronizing means comprises a microswitch for detecting the location of each frame at a position upstream of said predetermined position with respect to the direction of movement of the frame by said feeder means, and timer means for determining the time required for said feeder means to move the frame from said upstream position to said predetermined position.

* * * * *